US005996994A

United States Patent [19]

Becker

[11] Patent Number: 5,996,994

[45] Date of Patent: Dec. 7, 1999

[54] DEVICE FOR DETECTING MIS-FED OR MISSING SHEETS IN A TURNING DEVICE OF A PRINTING PRESS

[75] Inventor: Willi Becker, Bammental, Germany

[73] Assignee: Heidelberger Druckmaschinen Aktiengesellschaft, Heidelberg, Germany

[21] Appl. No.: 08/996,364

[22] Filed: Dec. 22, 1997

[30] Foreign Application Priority Data

Dec. 20, 1996 [DE] Germany ..... 196 53 353

[51] Int. Cl.[6] ..... B65H 7/12

[52] U.S. Cl. ..... 271/260; 271/265.01

[58] Field of Search ..... 271/260, 259, 271/265.01, 276, 196

[56] References Cited

U.S. PATENT DOCUMENTS 4,127,265 11/1978 Wirz et al. ..... 271/260

FOREIGN PATENT DOCUMENTS 2621250 3/1977 Germany .

41 14 320 A1 11/1992 Germany .

*Primary Examiner*—David H. Bollinger

*Attorney, Agent, or Firm*—Herbert L. Lerner; Laurence A. Greenberg

[57] ABSTRACT

A device for detecting mis-fed or missing sheets in a printing press having a storage drum includes a plurality of holding suction devices disposed on the storage drum and connected fluidically with one another via a first connecting line, a plurality of detecting suction devices disposed on the storage drum and connected fluidically with one another via a second connecting line, the holding suction devices and the detecting suction devices being formed with respective suction openings coverable at least partly by a sheet properly fed thereto, and a pressure monitoring device fluidically connected to the second connecting line for controlling the operation of the printing press in accordance with pressure prevailing in the second connecting line, the holding suction devices and the detecting suction devices being formed primarily of suction devices of the same type, the second connecting line having a cross section smaller than that of the first connecting line, and being connected fluidically with the first connecting line, and the first connecting line being connected fluidically with a negative pressure source.

12 Claims, 3 Drawing Sheets

DEVICE FOR DETECTING MIS-FED OR MISSING SHEETS IN A TURNING DEVICE OF A PRINTING PRESS

BACKGROUND OF THE INVENTION

Field of the Invention

The invention relates to a device for detecting mis-fed or missing sheets in a turning device of a printing press.

Devices for detecting mis-fed or missing sheets in turning devices of printing presses have become known heretofore and serve to detect defects in sheet position which occur when a sheet is turned, and any other disruptions in sheet travel, respectively, and to interrupt the printing process if a mis-fed or missing sheet, such as a short sheet, appears, in order thereby to avert damage to the printing press or parts thereof. Short sheets are produced, for example, due to tolerances in length of the sheets being processed, which for uncut papers can be in the range of several millimeters and, as a result of these tolerances, during the turning operation, the sheets are not correctly gripped by the grippers which grip the trailing edge of the sheet and are therefore lost.

Because of the high printing speed at which sheet-fed rotary offset printing presses are currently run, even in recto/verso or first-form and perfector printing, it is of major importance that the timespan within which a mis-fed or missing sheet is detected and the printing press is shutoff be very short, so that damage to the printing press can be reliably precluded even at the highest printing speeds.

From the published German Patent Document DE-AS 26 21 250, a sheet detecting device of this general type has become known wherein, on the storage drum of a turning device of a sheet-fed rotary offset printing press, a first row of suction grippers is provided in the vicinity of the trailing edge of the sheet for catching and holding the trailing edge of the sheet by suction as the sheet is being turned. The suction grippers are connected to a first negative pressure generator via a first connecting line.

As viewed in the rotary direction of the storage drum, upstream of the row of suction grippers, there is arranged a further row of detecting nozzles connected to a second negative pressure generator via a second connecting line and a pressure switch fluidically connected to the connecting line. Because a separate negative pressure generator is provided, the detecting nozzles can operate at a low constant pressure. The detecting nozzles are covered by the trailing edge of the sheet, when a sheet of normal length is being transported properly; consequently, the negative pressure in the second connecting line is maintained, and the pressure switch is not actuated. In the case of a mis-fed or a missing or short sheet, caused by some problem in the sheet travel, the openings of the detecting nozzles are covered only partially, if at all, by the trailing edge of the sheet; consequently, a change in pressure occurs in the second connecting line and is detected by the pressure switch which causes the immediate discontinuation of the printing process or shutoff of the printing press. A disadvantage of the hereinaforedescribed device is that two separate negative pressure sources with different pressures are required in order to permit safe and reliable operation of the device.

SUMMARY OF THE INVENTION

It is accordingly an object of the invention to provide a device for detecting mis-fed or missing sheets in a printing-press turning device which is formed of a comparatively small number of economically produced, mechanically sturdy components being unaffected by soiling during operation of the printing press, the detecting device, moreover, being so highly sensitive in operation that the time span for detecting a mis-fed or missing sheet is so brief that, in the event of a problem, the printing press can be stopped in sufficient time for reliably avoiding damage to the printing press, even at maximum production-run speeds.

With the foregoing and other objects in view, there is provided, in accordance with the invention, a device for detecting mis-fed or missing sheets in a printing press having a storage drum, comprising a plurality of holding suction devices disposed on the storage drum and connected fluidically with one another via a first connecting line, a plurality of detecting suction devices disposed on the storage drum and connected fluidically with one another via a second connecting line, the holding suction devices and the detecting suction devices being formed with respective suction openings coverable at least partly by a sheet properly fed thereto, and a pressure monitoring device fluidically connected to the second connecting line for controlling the operation of the printing press in accordance with pressure prevailing in the second connecting line, the holding suction devices and the detecting suction devices being formed primarily of suction devices of the same type, the second connecting line having a cross section smaller than that of the first connecting line, and being connected fluidically with the first connecting line, and the first connecting line being connected fluidically with a negative pressure source.

In accordance with another feature of the invention, the holding suction devices and the detecting suction devices are constructed as rotary suction devices actuatable for tautening the sheets before they are transferred to a downstream sheet-guiding cylinder of the printing press.

In accordance with a further feature of the invention, the detecting device includes an adjustable valve via which the second connecting line and the first connecting line are fluidically connected to one another.

In accordance with an added feature of the invention, respective cross-sectional areas of the first and the second connecting lines are at a ratio substantially equal to the ratio between the plurality of holding suction devices connected to the first connecting line and the plurality of the detecting suction devices connected to the second connecting line.

In accordance with an additional feature of the invention, respective cross-sectional areas of the first and the second connecting lines have a ratio to one another at least equal to two.

In accordance with yet another feature of the invention, the detecting suction devices are disposed adjacent the trailing edge of the respective sheet.

In accordance with yet a further feature of the invention, the suction devices of at least one subset of respective subsets of the holding suction devices and the detecting suction devices are disposed equidistantly from one another on the circumferential surface of the storage drum along an axis extending substantially parallel to the rotary axis of the storage drum.

In accordance with yet an added feature of the invention, the pressure monitoring device is disposed in the second connecting line.

In accordance with yet an additional feature of the invention, the pressure monitoring device includes a spring-loaded piston disposed in a cylinder and movable by applied negative pressure in the second connecting line, the operation of the printing press being controllable in accordance with the position of the piston.

In accordance with still another feature of the invention, the detecting device includes a rotary valve formed with respective first and second control grooves connected in a locally stationary manner to a side wall of the printing press, the first and second control grooves, respectively, being associated with the first and second connecting lines, respectively, and being formed with respective first and second control openings rotating with the storage drum and being correspondingly associated with the first and second control grooves.

In accordance with still a further feature of the invention, the first and the second control grooves are disposed opposite one another relative to the rotary axis of the storage drum.

In accordance with a concomitant feature of the invention, the detecting device is combined with a turning device of a printing press having a storage drum.

The detecting device according to the invention offers the advantage, in particular, that the components thereof are mechanically sturdy in construction and accordingly have only very slight vulnerability to malfunction as well as reduced vulnerability to the soiling which necessarily occurs during printing press operation, such as paper dust deposits, pigment deposits, and so forth. It is also an advantage of the device of the invention that its operation requires only one negative pressure source, and that even in printing press with a large number of suction grippers for holding the trailing edge of the sheet and a comparatively low number of detecting suction devices in the case of short sheets, wherein the detecting suction devices are not covered or are only partially covered by the trailing edge of the sheet, very rapid response of the device occurs even when comparatively insensitive pressure monitoring devices are used. Moreover, the device of the invention offers the advantage that by the use of suction devices to detect mis-fed or missing sheets, an increased holding force for holding the trailing edge of the sheet is provided, without any additional expenditure of energy for producing additional negative pressure.

Other features which are considered as characteristic for the invention are set forth in the appended claims.

Although the invention is illustrated and described herein as embodied in a device for detecting defective or missing sheets in an inverter device of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
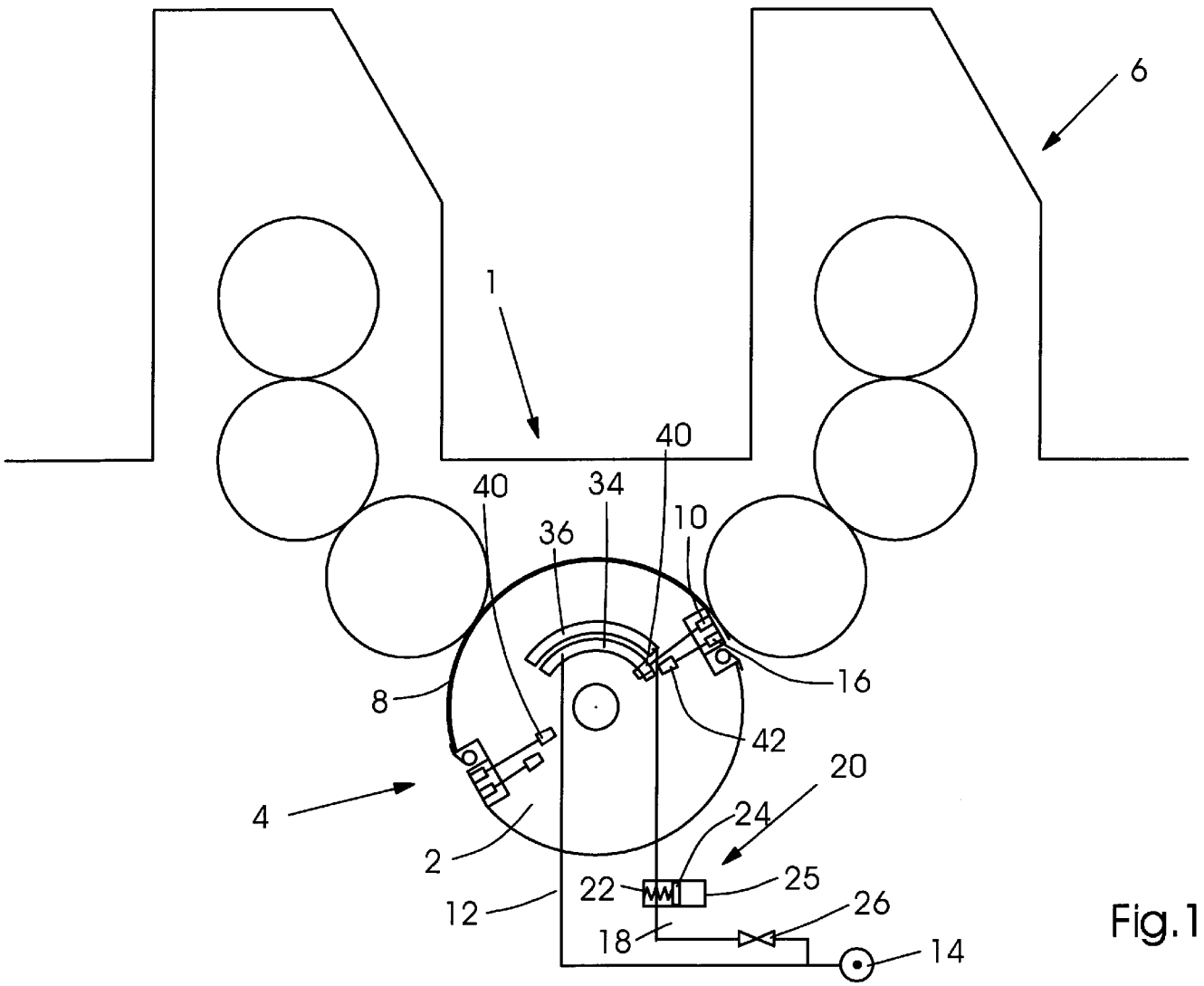
FIG. 1 is a diagrammatic and schematic side elevational view of a printing press with a turning device and a device disposed thereon for detecting mis-fed or missing sheets in accordance with the invention.
Figure 2:
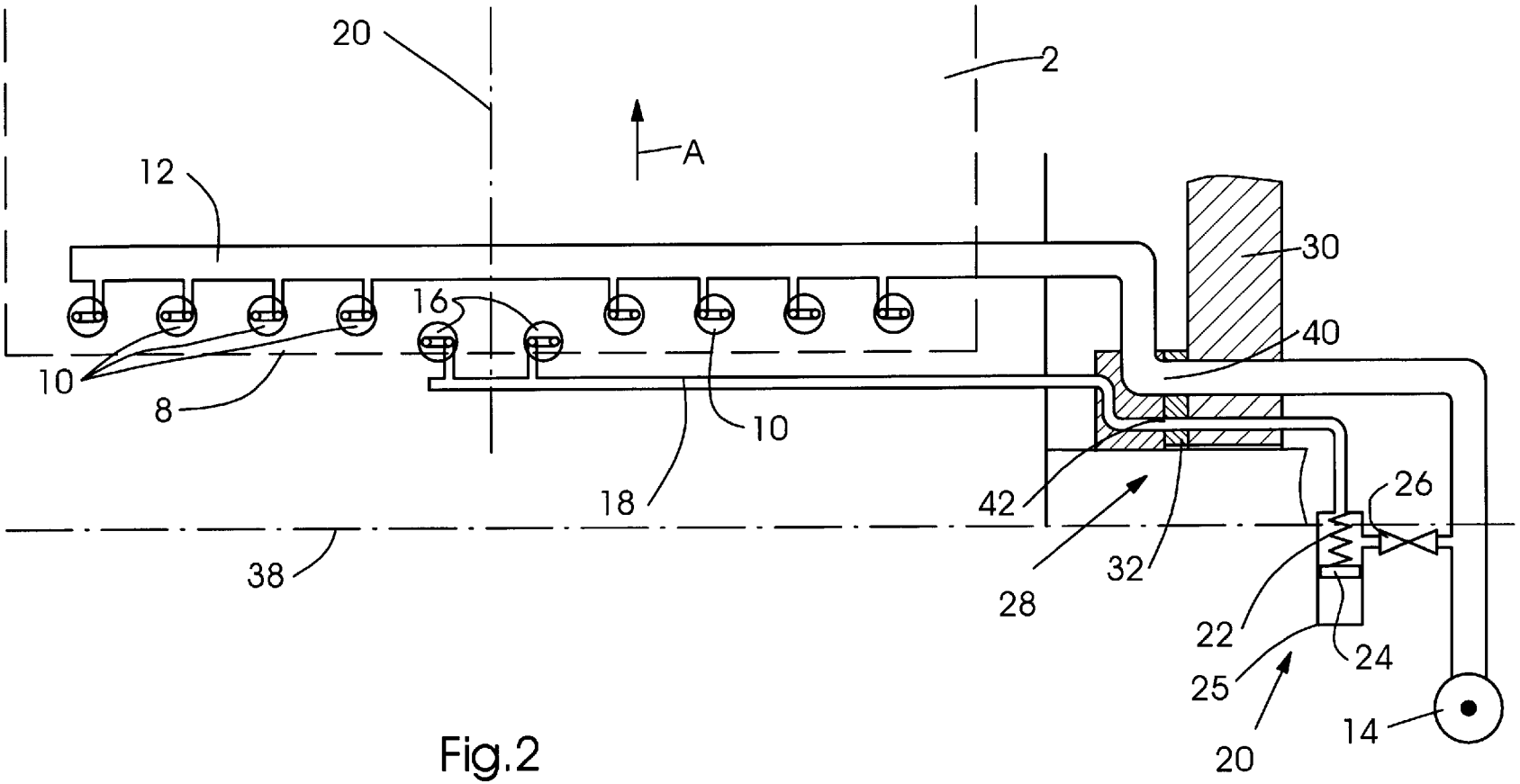
FIG. 2 is an enlarged diagrammatic and schematic plan view of the storage device formed as a storage drum of the printing press of FIG. 1, with a more detailed view of the components belonging to the device of the invention.

Referring now to the drawings and, first, to FIG. 1 thereof, there is shown therein a device 1 for detecting mis-fed or missing sheets at a storage drum 2 of a turning device 4 of a printing press 6, the detecting device 1 including a first group of holding suckers or suction devices 10, disposed on the storage drum 2 in the vicinity of the trailing edge of a sheet 8, the holding suckers 10 preferably extending in a row axially along the storage drum 2 and being connected via a first common connecting line 12 to a negative pressure source 14. As shown in FIG. 1, detecting suckers or suction devices 16, which communicate fluidically with the first connecting line 12 via a second connecting line 18 of lesser diameter, are disposed upstream of the holding suckers or suction devices 10, as viewed in the sheet travel direction counterclockwise on the storage drum 2. As shown in FIGS. 1 and 2, a conventional pressure monitoring device 20 is located in the second connecting line 18 and, in accordance with the negative pressure prevailing in the second connecting line 18, the pressure monitoring device controls the operation of the printing press 2. Whenever a sheet 8 is carried properly on the storage drum 2 during recto/verso or first form and perfecter printing, the suction openings of the detecting suction devices 16 are covered by the trailing edge of the respective sheet 8, so that the negative pressure in the second connecting line 18 is maintained, and the pressure switch 20 does not turn off the printing press.

Should it be that, during the recto/verso or first form and perfecter printing mode of the printing press 6, a respective sheet 8 is not transferred correctly or fails to be transferred at all or is too short at the trailing edge thereof, the suction openings of the detecting suction devices 16 are only partially covered by the rear edge of the sheet 8 or even remain entirely open, due to which the negative pressure in the second connecting line 18 breaks down, and the pressure monitoring device 20 turns off the printing press 6 or parts of the pressure circuit thereof, so that the mis-fed or missing sheet does not cause any damage to the printing press, and the succeeding impression cylinder is prevented from printing.

In a preferred embodiment of the invention, the pressure monitoring device 20 includes a piston 24, loaded by a spring 22, which is moved to various positions inside a housing 25 by the negative pressure in the second connecting line 18. The instant a mis-fed or missing sheet causes the negative pressure in the second connecting line 18 to break down, because one or more suction openings of the detecting suction devices 16 are then no longer covered, and the piston 24 is then moved to a predetermined position, the printing press 6 is turned off by control devices of the pressure switch 20 which are not otherwise shown in detail in the drawings. To enable the negative pressure and, consequently, the threshold value, to be varied, for shutting off the printing press 6, it is possible, in the preferred embodiment of the invention as shown in FIGS. 1 and 2, for a suitable valve 26 to be provided in the second connecting line 18, and to be preferably disposed between the pressure monitoring device 20 and the first connecting line 12.

The valve 26 is preferably a manually actuatable valve, but it may also be constructed as a valve which is actuatable pneumatically or electrically or in some other manner.

In the preferred embodiment of the invention, both the holding suction devices 10 and the detecting suction devices 16 are constructed as conventional eccentric rotary suction devices, which attach themselves by suction to the sheet 8 at the trailing edge thereof and subsequently tauten the sheet 8 in both the longitudinal and the diagonal direction thereof. The holding suction devices 10 and detecting suction devices 16 may, however, be constructed in a manner similar to that of other conventional types of suction devices, both the holding suction devices 10 and the detecting suction devices 16, in all cases, belonging primarily to the same type of suction device, however.

The cross-sectional areas of the first connecting line 12 and the second connecting line 18 are also preferably selected in such a manner that the ratio of the cross-sectional areas of the first and second connecting lines 12 and 18 is approximately equal to the ratio between the number of holding suction devices 10 connected to the first connecting line 12 and the number of detecting suction devices 16 connected to the second connecting line 18. The number of holding suction devices 10 is preferably considerably greater than the number of detecting suction devices 16, the number of holding suction devices 10 being by no means limited to the total of eight holding suction devices 10 shown in FIG. 2, but rather, in the same manner, may have a less or greater value. This applies accordingly to the detecting suction devices 16, the number of which is not limited to the two suction devices shown but may also be greater. The ratio of the cross-sectional areas of the first and the second connecting lines 12 and 18 preferably is of a value greater than two. Provision may also be made for the detecting suction devices 16 to be disposed adjacent to or between the holding suction devices 10.

In the preferred embodiment of the invention, the holding suction devices 10, respectively, and/or the detecting suction devices 16, respectively, are preferably disposed equidistantly from one another along an axis disposed on the circumferential surface of the storage drum 2 and extending substantially parallel to the rotary axis 38 of the storage drum 2, as shown, for example, in FIG. 2.

Figure 3:
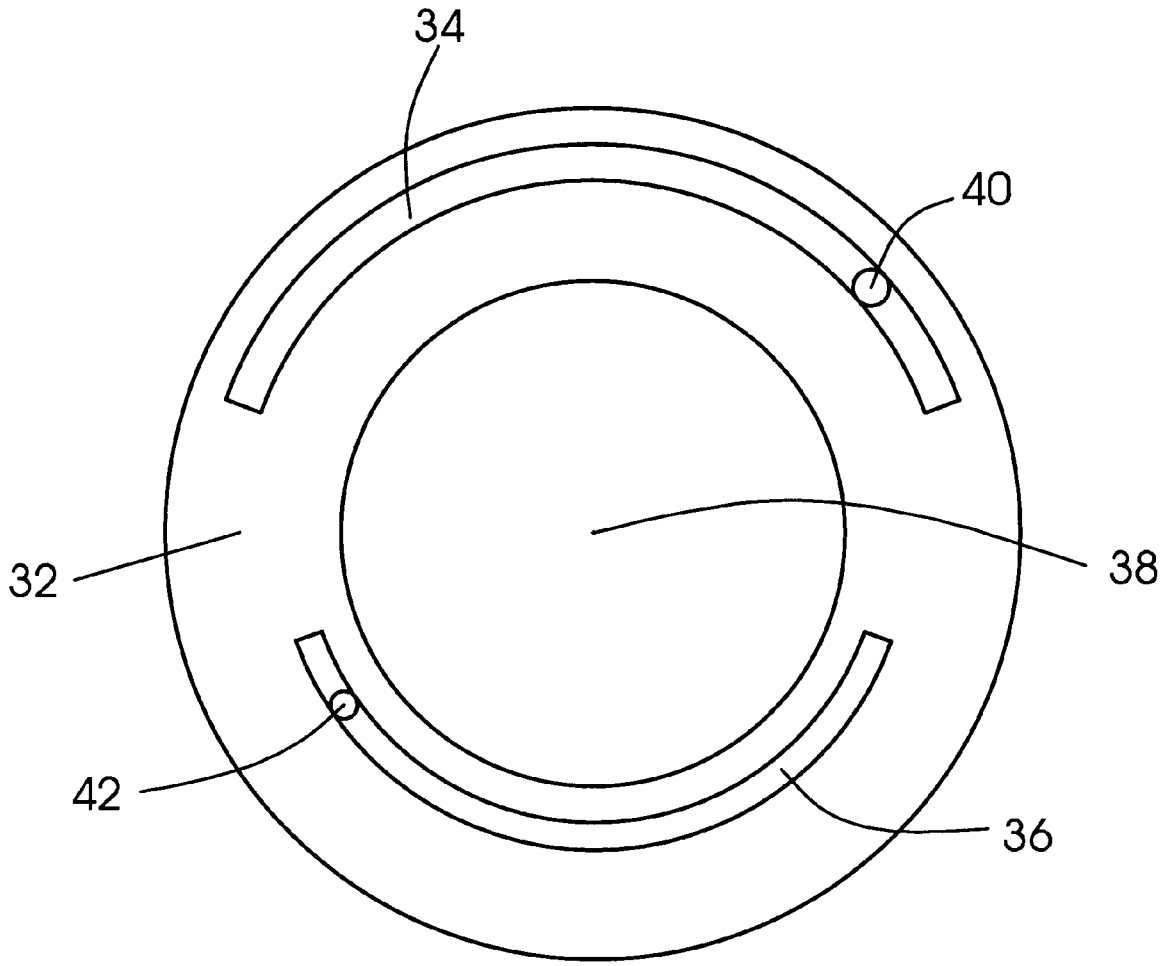
FIG. 3 is an enlarged fragmentary, diagrammatic side elevational view of FIG. 2 showing a preferred embodiment of a rotary valve through which connecting lines of the holding suckers or suction devices and of the detecting suckers or suction devices of the rotating storage drum are passed to an external stationary negative pressure source.

In this embodiment of the invention, the supply of suction from the negative pressure source 14 to the holding suction devices 10 or detecting suction devices 16 is preferably effected through a rotary valve or rotary lead-through 28, which has a valve ring 32 connected in a locally fixed or stationary manner to a side wall 30 of the printing press, the valve ring 32, as shown in FIG. 3, being formed with a first control groove 34 for supplying suction to the holding suction devices 10, and a second control groove 36 for supplying suction to the detecting suction devices 16. As further shown in FIG. 3, the first and second control grooves 34 and 36 are preferably disposed opposite one another and concentrically to the rotary axis 38 of the storage drum 2, the control grooves 34 and 36, as viewed in the radial direction of the valve ring 32, being offset from one another without overlap. An advantage of the aforedescribed construction, when compared with an arrangement of the control grooves 34 and 36 parallel to one another on one and the same side of the valve ring 32, is that even if there should be a slight radial spacing of the control grooves 34 and 36 from one another, a spillover of misdirected air is averted. Moreover, on the side of the rotating storage drum 2, the rotary valve 28 is formed with a control opening 40 corresponding with the first groove 34, and a second control opening 42 corresponding with the second groove 36, these control openings 40 and 42, respectively, forming the respective end of the portion of the first connecting line 12 and the second connecting line 18, respectively, disposed in the rotating storage drum 2. During the rotation of the storage drum 2, the holding suction devices 10 and the detecting suction devices 16 are thus connected periodically with the negative pressure source 14 via the first and second control openings 40 and 42 and the first and second control grooves 34 and 36, respectively, associated therewith.

Although the detecting device according to the invention has been operated in conjunction with a turning device of a printing press, it can also be employed, in principle, in other regions of a printing press, for example, in the feeder region, the delivery region, on sheet guidance and control baffles, and so forth, for detecting mis-fed or missing sheets.

We claim:

1. A device for detecting mis-fed or missing sheets in a printing press having a storage drum, comprising a plurality of holding suction devices disposed on the storage drum and connected fluidically with one another via a first connecting line, a plurality of detecting suction devices disposed on the storage drum and connected fluidically with one another via a second connecting line, said holding suction devices and said detecting suction devices being formed with respective suction openings coverable at least partly by a sheet properly fed thereto, and a pressure monitoring device fluidically connected to said second connecting line for controlling the operation of the printing press in accordance with pressure prevailing in said second connecting line, said holding suction devices and said detecting suction devices being formed primarily of suction devices of the same type, said second connecting line having a cross section smaller than that of said first connecting line, and being connected fluidically with said first connecting line, and said first connecting line being connected fluidically with a negative pressure source.

2. The detecting device according to claim 1, wherein said holding suction devices and said detecting suction devices are constructed as rotary suction devices actuatable for tautening the sheets before they are transferred to a downstream sheet-guiding cylinder of the printing press.

3. The detecting device according to claim 1, including an adjustable valve via which said second connecting line and said first connecting line are fluidically connected to one another.

4. The detecting device according to claim 1, wherein respective cross-sectional areas of said first and said second connecting lines are at a ratio substantially equal to the ratio between the plurality of holding suction devices connected to said first connecting line and the plurality of said detecting suction devices connected to said second connecting line.

5. The detecting device according to claim 1, wherein respective cross-sectional areas of said first and said second connecting lines have a ratio to one another at least equal to two.

6. The detecting device according to claim 1, wherein said detecting suction devices are disposed adjacent the trailing edge of the respective sheet.

7. The detecting device according to claim 1, wherein the suction devices of at least one subset of respective subsets of said holding suction devices and said detecting suction devices are disposed equidistantly from one another on the circumferential surface of the storage drum along an axis extending substantially parallel to the rotary axis of the storage drum.

8. The detecting device according to claim 1, wherein said pressure monitoring device is disposed in said second connecting line.

9. The detecting device according to claim 1, wherein said pressure monitoring device includes a spring-loaded piston disposed in a cylinder and movable by applied negative pressure in said second connecting line, the operation of the printing press being controllable in accordance with the position of said piston.

10. The detecting device according to claim 1, including a rotary valve formed with respective first and second control grooves connected in a locally stationary manner to a side wall of the printing press, said first and second control grooves, respectively, being associated with said first and said second connecting lines, respectively, and being formed with respective first and second control openings rotating with the storage drum and being correspondingly associated with said first and said second control grooves.

11. The detecting device according to claim 10, wherein said first and said second control grooves are disposed opposite one another relative to the rotary axis of the storage drum.

12. The detecting device according to claim 1, in combination with a turning device of a printing press having a storage drum.

* * * * *